US005860797A

United States Patent [19]

Fujimura et al.

[11] Patent Number: 5,860,797

[45] Date of Patent: Jan. 19, 1999

[54] FLOW RATE CONTROL DEVICE FOR A PUMP

[75] Inventors: Haruo Fujimura; Shunichi Higuchi; Kazuhiro Maki, all of Aichi, Japan

[73] Assignee: Aisin Seiki Kabushiki Kaisha, Kariya, Japan

[21] Appl. No.: 627,125

[22] Filed: Apr. 3, 1996

[30] Foreign Application Priority Data

Apr. 4, 1995 [JP] Japan ..... 7-078658
Apr. 20, 1995 [JP] Japan ..... 7-095029

[51] Int. Cl.[6] ..... F04B 49/24

[52] U.S. Cl. ..... 417/440; 417/300; 417/307; 137/115.06

[58] Field of Search ..... 417/440, 441, 417/300, 310, 274, 285, 288, 299, 301, 303, 307; 137/115.01, 492.5, 115.03, 115.05, 115.06, 115.1, 115.08, 115.16–15.2; 251/333, 343, 344

[56] References Cited

U.S. PATENT DOCUMENTS 3,656,870 4/1972 Kusakabe et al. ..... 417/310 X
4,311,161 1/1982 Narumi et al. ..... 417/300 X
4,396,033 8/1983 Narumi et al. ..... 417/307 X
4,431,381 2/1984 Falendysz et al. ..... 417/307 X
4,768,540 9/1988 Mochizuki et al. ..... 137/115.1

FOREIGN PATENT DOCUMENTS 6-71889 9/1994 Japan .

*Primary Examiner*—Ismael Izaguirre
*Attorney, Agent, or Firm*—Burns, Doane, Swecker & Mathis, LLP

[57] ABSTRACT

A flow rate control device for a pump includes a housing, a choke tubular passageway connected between a pump pressure chamber and an output chamber, a spool valve which is slidably provided in the housing, and which has both ends exposed in the pump pressure chamber and the pressure reducing chamber, respectively, the spool valve causing a pressure medium to flow from the pump pressure chamber into the by-pass port as much as the spool valve slides in an axial direction thereof. In the device, the choke tubular passageway is formed in a central shaft member arranged in the housing, and a sleeve member is provided around the central shaft member, the sleeve member being moved, from the pump pressure chamber towards the pressure reducing chamber, with respect to the central shaft member, in such a manner as to change the opening area of the choke tubular passageway.

10 Claims, 4 Drawing Sheets

FLOW RATE CONTROL DEVICE FOR A PUMP

BACKGROUND OF THE INVENTION

1. Field of the Invention

This invention relates to a flow rate control device for a hydraulic pump which is applied mainly to a steering device of an automobile.

2. Description of the Related Art

A flow rate control device for a hydraulic pump has been disclosed, for instance, in Japanese Patent Application Examined Publication No. Hei 6-71889. The conventional flow rate control device disclosed therein comprises: a flow rate control valve that by-passes a pressure medium according to a pump discharge flow rate which changes with the speed of rotation of a pump, so that the discharge flow rate is made constant independently of the speed of rotation of the pump; and a change-over valve which operates according to a load pressure produced according to the operating condition of the steering device. That is, it is a flow rate control device of the load-sensitive type which, when the load of the steering device increases, causes the pump to increase the flow rate of operating fluid applied to the steering device.

However, as was described above, the conventional flow rate control device needs the flow rate control valve and the change-over valve which are two completely independent valves. Therefore, the flow rate control device is unavoidably bulky, thereby making it rather difficult to install it in the recently overcrowded engine room in which a large number of components have been installed. That is, it has problems to be solved for its installation in the engine room and for reduction of the weight thereof.

SUMMARY OF THE INVENTION

In view of the foregoing, an object of the invention is to provide a load-sensitive flow rate control device for a pump which is small in size and light in weight.

The foregoing object of the invention has been achieved by the provision of a flow rate control device for a pump which comprises:

a housing;

a pump pressure chamber provided in the housing into which a pump discharge pressure is led;

a choke tubular passageway communicating with the pump pressure chamber;

an output chamber which communicates through the choke tubular passageway with the pump pressure chamber, and to which a pressure obtained by reducing a pump discharge pressure is led;

a pressure reducing chamber which is provided in the housing and communicates with the output chamber;

a by-pass port which is provided in the housing and communicates with a pump suction side; and a spool valve which is slidably provided in the housing, which has both ends exposed in the pump pressure chamber and the pressure reducing chamber, respectively, the spool valve causing a pressure medium from the pump pressure chamber to flow into the by-pass port as much as the spool valve slides in an axial direction thereof;

wherein the choke tubular passageway is formed in a central shaft member arranged in the housing, and a sleeve member is provided around the central shaft member, the sleeve member being moved, from the pump pressure chamber towards the pressure reducing chamber, with respect to the central shaft member, in such a manner as to change the opening area of the choke tubular passageway.

With the flow rate control device of the invention, the spool valve is slid on the difference between the pressures applied to both ends of the spool valve, so that the opening degree of the by-pass port is adjusted, and the pressure medium is by-passed. Thus, the pump discharge flow rate can be made constant independently of the speed of rotation of the pump.

Furthermore, the load pressure increased depending on the operating condition of the steering device is applied to the sleeve member, so that the latter moves with respect to the central shaft member to increase the opening area of the choke tubular passageway. Thus, because the opening area of the choke tubular passageway is increased, the discharge flow rate can be increased in accordance with the load pressure produced by the steering device.

The above and other objects and features of the present invention will be more apparent from the following description taken in conjunction with the accompanying drawing.

DETAILED DESCRIPTION OF THE PREFERRED EMBODIMENTS

Now, parts of a flow rate control device for a hydraulic pump, which form specific features of the invention, will be described with reference to the accompanying drawings.

Figure 4:
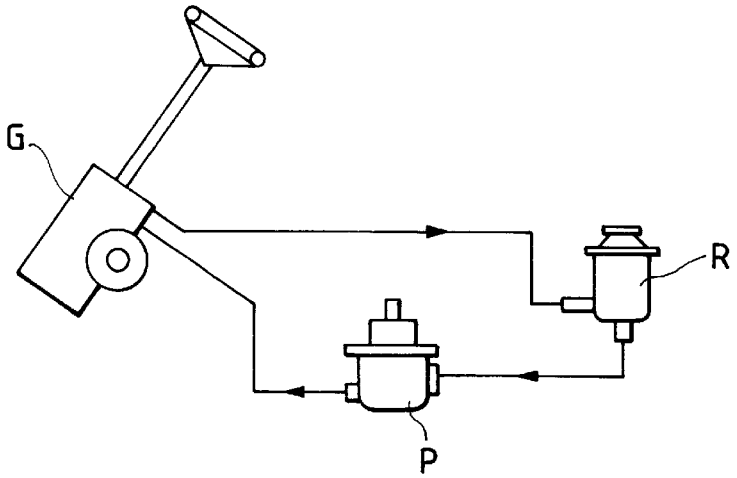
FIG. 4 is an explanatory diagram showing a steering system.

FIG. 4 is a diagram showing a general steering system using a vane pump. In FIG. 4, reference numeral G designates a steering device for converting the steering operation of a vehicle operator, which is applied to a steering wheel (handle), into the displacement of the steered wheel; R, a reservoir that stores a pressure medium which is an operating fluid; and P is a vane pump with the flow rate control device according to the invention. The vane pump P sucks the operating fluid from the reservoir R, and after adjusting its flow rate to a predetermined value, discharges it to the steering device G, thereby to assist the steering operation of the operator.

Figure 1:
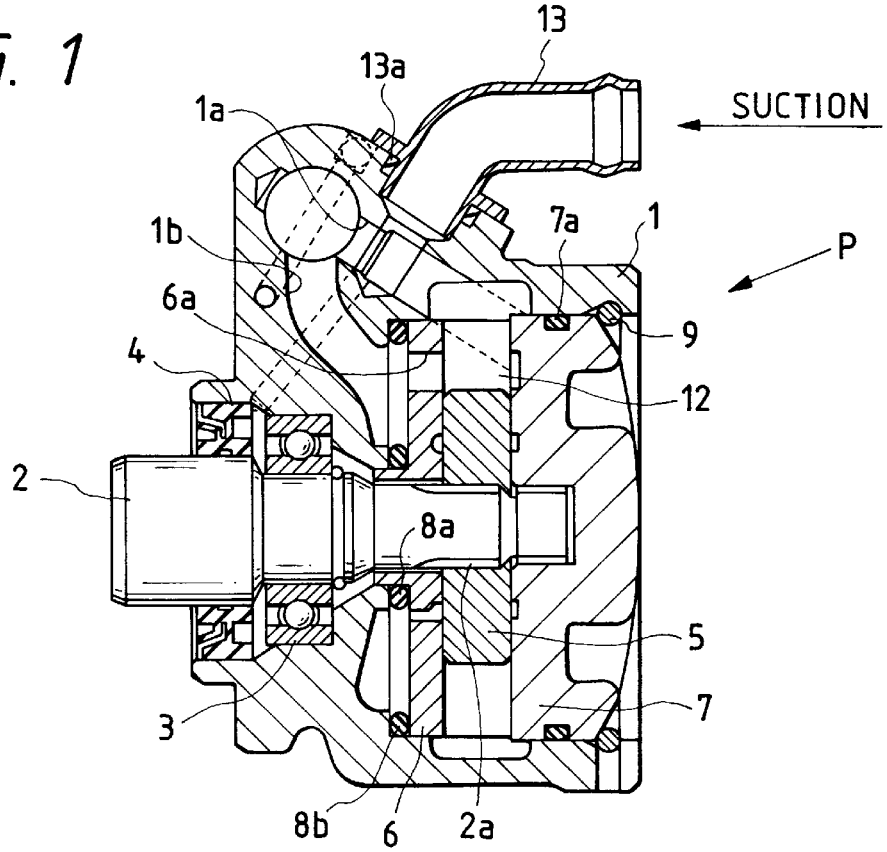
FIG. 1 is a cross-sectional view taken in the direction of axis of a vane pump equipped with a flow rate control device for a pump according to the invention.

FIG. 1 is a cross-sectional view showing the vane pump P taken along the axis of rotation. The vane pump P as shown in FIG. 1, has a housing 1, into which a rotary shaft 2 is inserted. The torque of an engine of a vehicle is transmitted through a pulley (not shown) to the rotary shaft 2. More specifically, the rotary shaft 2 is supported through a bearing 3 on the housing 1. In addition, a seal member 4 is provided between the housing 1 and the rotary shaft 2, thus preventing the entrance of water, dust, etc. into the pump.

A rotor 5 is mounted through a spline 2*a* on the rotary shaft 2 in such a manner that it turns together with the rotary shaft 2. A pressure plate 6 and a thrust plate 7 are provided on both sides of the rotor 5. The pressure plate 6 has a discharge hole 6*a,* and is sealingly held by O-rings 8*a* and 8*b* in the housing 1, which are arranged along the inner periphery and the outer periphery of the pressure plate 6, respectively. On the other hand, the thrust plate 7 is sealingly held by an O-ring 7*a* in the housing 1, which is arranged along the outer periphery of the thrust plate 7. Furthermore, the thrust plate 7 is locked with a snap ring 9 at the right end in FIG. 1. Hence, the aforementioned rotor 5 is held between the pressure plate 6 and the thrust plate 7.

Figure 2:
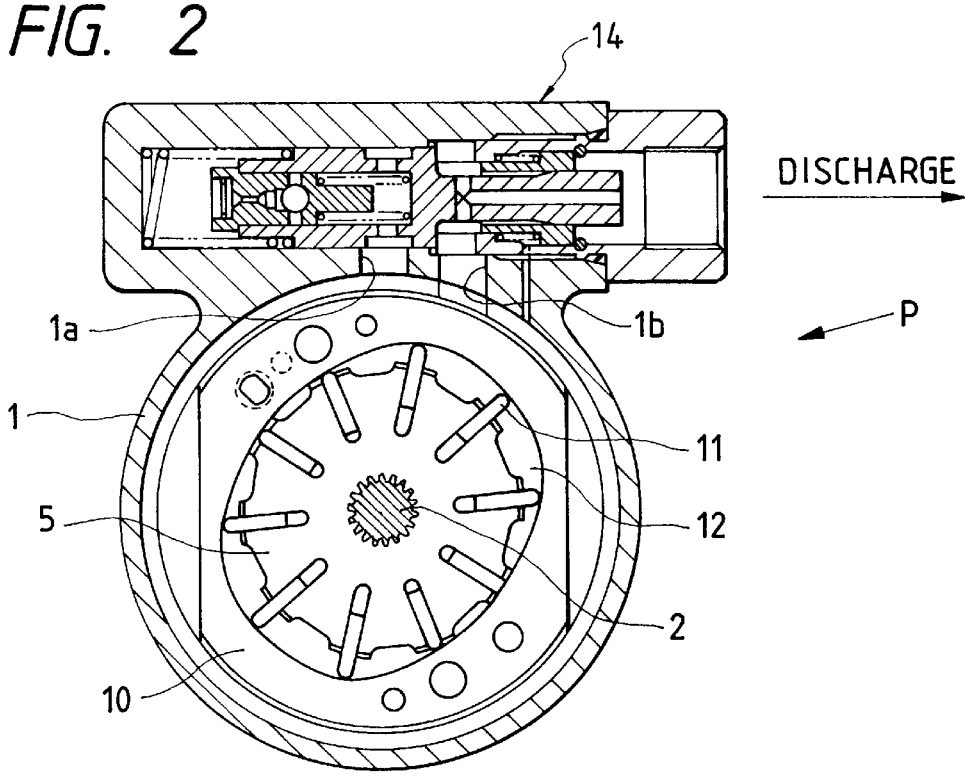
FIG. 2 is a cross-sectional front view showing the vane pump having the flow rate control device of the invention.

A cam ring 10, as shown in FIG. 2, is provided along the outer periphery of the rotor 5. The rotor 5 has a plurality of vanes 11 which are movable radially of the rotor 5 so that they abut against the cam ring 10. Between the rotor 5 and the cam ring 10, a pump chamber 12 is formed which is divided by the vanes 11 into a plurality of parts.

The housing 1 has an inlet 13 which is used to receive the operating fluid from the reservoir R. More specifically, it is fluidly tightly fitted in the housing 1 through an O-ring 13*a* and communicates with a by-pass port 1*a* formed in the housing 1. The by-pass port 1*a* communicates with the pump chamber 12 and a flow rate control device 14 (described later).

The housing 1 includes an input port 1*b*, which communicates with the discharge hole 6*a* of the pressure plate 6 and with the aforementioned flow rate control device 14.

Figure 3:
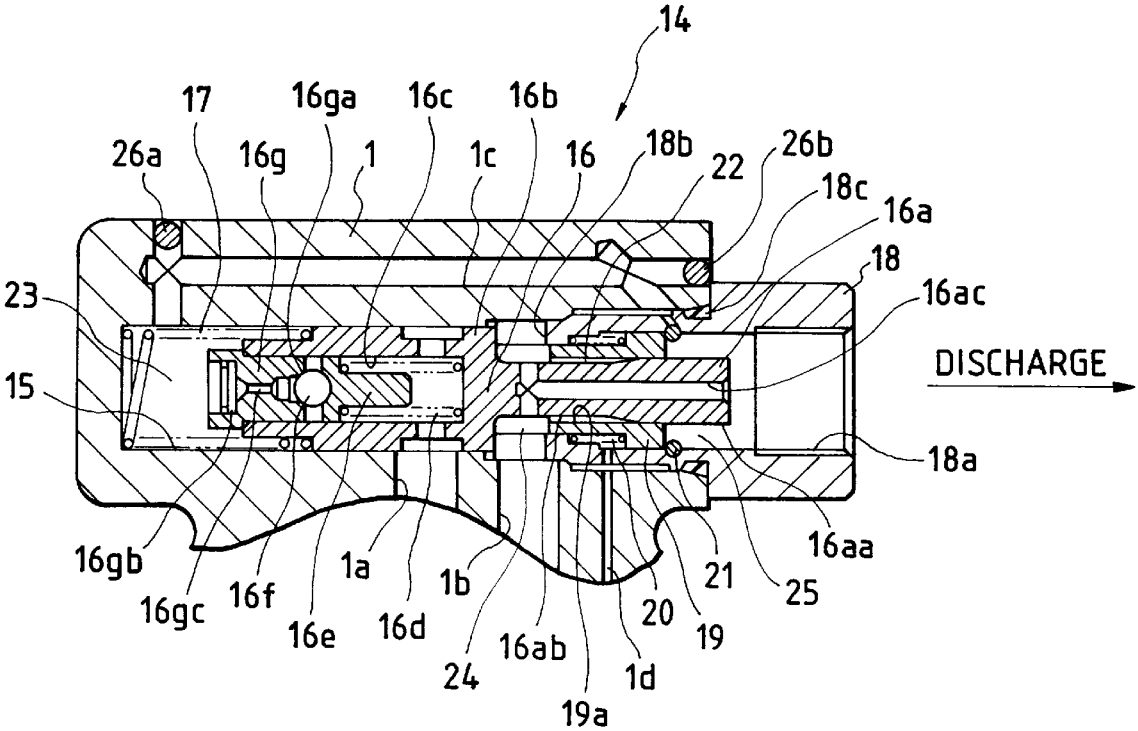
FIG. 3 is an enlarged sectional view showing a flow rate control device according to a first embodiment of the invention.

FIG. 3 is an enlarged diagram showing the aforementioned flow rate control device 14. The housing 1 has an inner hole 15, in which a spool valve 16 is inserted in such a manner that it is axially slidable. The spool valve 16, being engaged with a spring 17, is urged toward the right side in FIG. 3, thus being abutted against a plug 18 (described later). The spool valve 16 includes an elongated portion 16*a* which is elongated to the right in FIG. 3. The elongated portion 16*a* is not uniform in outer diameter; that is, its base end portion, namely, a small-diameter portion 16*ab* is slightly smaller in diameter than its front end portion, namely, a large-diameter portion 16*aa*. In this connection, it should be noted that the large-diameter portion 16*aa* is coupled to the small-diameter portion 16*ab* through a gradually curved annular surface.

The above-mentioned plug 18 serving as one member constituting the housing 1 is threadably engaged with the right end of the aforementioned inner hole 15. The plug 18 has a discharge port 18*a* which is adjusted in pump discharge flow rate by the flow rate control device 14 and through which the operating fluid is discharged towards the above-described steering device G.

A sleeve member 19 is provided between the plug 18 and the spool valve 16 in such a manner that it is slidable in its axial direction. The sleeve member 19 is urged to the right in FIG. 3 by a spring 20 so that it is abutted against a snap ring 21 which is secured to the plug 18. The sleeve member 19 has a flow rate hole 19*a,* which forms a choke tubular passageway 22 in combination with the large-diameter portion 16*aa* and the small-diameter portion 16*ab* of the spool valve 16. The aforementioned elongated portion 16*a* has a pipe passageway 16*ac* having a choke effect. An O-ring 18*c* is employed to fluidly tightly isolate the inner hole 15 from the outside, and a communicating hole 1*d* communicates with the pump suction side.

The spool valve 16 has a valve section 16*b,* and as the spool valve 16 is axially moved, the input port 1*b* communicates with or is isolated from the by-pass port 1*a*.

The spool valve 16 has a valve hole 16*c*. A retainer 16*e* is urged by a spring 16*d,* and a ball 16*f* are sealingly set in the valve hole 16*c*. Under this condition, a valve plug 16*g* is threadably engaged with the valve hole 16*c*. The valve plug 16*g* has a valve seat 16*ga,* a strainer 16*gb* for removing foreign matter, and a fluid passageway 16*gc*. Those members serve as a relief valve to prevent the flow rate control device 14 from being damaged when the pump discharge pressure becomes abnormally high.

A pressure reducing chamber 23 is provided on the left side of the spool valve 16 in FIG. 3, and an input pressure chamber 24 is provided on the right side of the valve section 16*b,* and a discharge pressure chamber 25 is provided on the right side of the spool valve 16. The pressure reducing chamber 23 and the discharge pressure chamber 25 communicate with each other through a communicating passageway 1*c* formed in the housing 1. In FIG. 3, reference characters 26*a* and 26*b* designate ball plugs which sealingly close the communicating passageway 1*c* from the outside.

Now, the operation of the embodiment thus constructed will be described.

When the rotation of the engine is transmitted through a pulley (not shown) to the rotary shaft 2, the rotor 5 is turned together with the latter 2. The pump chamber 12 formed between the rotor 5 and the cam ring 10 repeatedly expands and contracts as the rotor 5 rotates. Hence, the operating fluid sucked in from the reservoir R through the inlet 13 and the bypass port 1*a* is increased in pressure during compression into a pump discharge pressure. The pressure thus formed is led into the input chamber 24 of the flow rate control device 14 through discharge hole 6*a* of the pressure plate 6 and the input port 1*b*.

Figure 5:
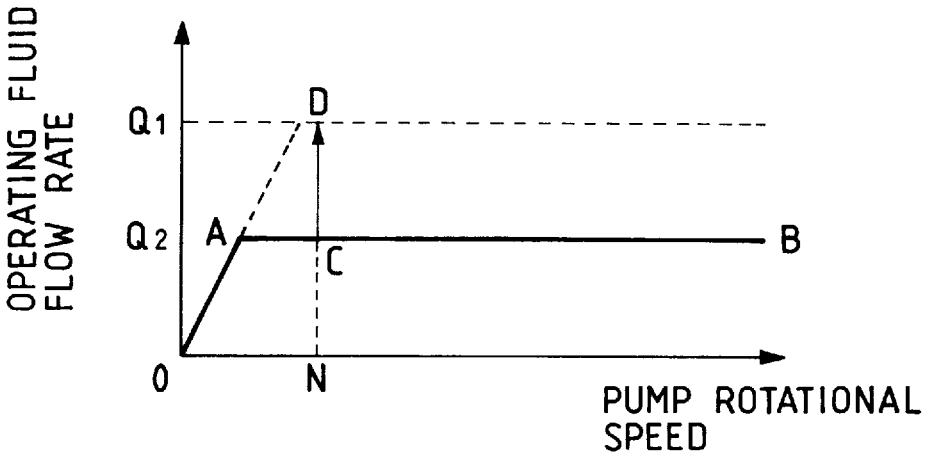
FIG. 5 is a characteristic diagram for a description of the discharge flow rate of the flow rate control device of the invention.

Part of the operating fluid, which is led in the input pressure chamber 24 and provides the pump discharge pressures, is led into the discharge pressure chamber 25 through the choke tubular passageway 22 between the elongated portion 16*a* of the spool valve 16 and the sleeve member 19, and the pipe passageway 16*ac* with a choke effect, which is provided at the elongated portion 16*a*. Thus, the operating fluid is allowed to flow through the choke tubular passageway 22 at a predetermined flow rate, so that the pump discharge pressure, being reduced to a predetermined value, is transmitted to the discharge pressure chamber 25. The pressure is simultaneously applied through the communication passageway 1*c* to the pressure reducing chamber 23. Hence, the spool valve 16 is moved toward the left in FIG. 3 until the sum of the elastic force of the spring 17 and the pressure which is obtained by reducing the pump discharge pressure in the pressure reducing chamber 23; that is, a force of urging the spool valve 16 to the right in FIG. 3 is balanced with a force of urging the spool valve to the left in FIG. 3 which is provided by the pump discharge pressure led into the input pressure chamber 24. Since the spool valve 16 is moved to the left in FIG. 3 in the above-described manner, the valve section 16*b* of the spool valve 16 allows the by-pass port 1*a* and the input port 1*b* to communicate with each other, so that a predetermined amount of operating fluid returns from the input pressure chamber 24 through the by-pass port 1*a* into the reservoir R. Hence, the spool valve 16 is moved to the left in FIG. 3 as much as the distance corresponding to the pump discharge flow rate; that is, the degree of opening of the by-pass port 1*a* is adjusted as much as the aforementioned amount of movement, to return the operating fluid into the reservoir R. Therefore, even if the pump discharge flow rate increases, the quantity of operating fluid discharged towards the steering device G is limited to a given value. In FIG. 5, the relationships between pump rotational speeds and operating fluid flow rates are indicated by a curve O-A-B. In this case, the sleeve member 19 is held at the right end as shown in FIG. 3. Hence, irrespective of the movement of the spool valve 16, the choke tubular passageway 22 is defined by the flow rate hole 19*a* of the sleeve member 19 and the large-diameter portion 16*aa* of the spool valve 16, and therefore its sectional area is small. On the other hand, it should be noted that the pipe passageway 16*ac* is maintained unchanged in sectional area.

When, as in the case where the operator operates the steering device G with the vehicle at a low speed (the pump speed being N), the load pressure is increased on the side of the steering device G, the load pressure is led to the discharge pressure chamber 25 located at the right end of the spool valve 16, and therefore the sleeve member 19 receives the load pressure, thus being moved to the left in FIG. 3 against the elastic force of the spring 20. As the sleeve member 19 is moved to the left with respect to the spool valve 16, the portion of the choke tubular passageway 22 which is defined by the flow rate hole 19*a* of the sleeve member 19 and the small diameter portion 16*ab* of the spool valve 16 (the portion of the choke tubular passageway 22 which is large in sectional area) is increased in length. Therefore, the pressure which is provided by reduction of the pump discharge pressure in the choke tubular passageway 22 is increased, and the pressure in the pressure reducing chamber 23 is also increased. Hence, the spool valve 16 is moved to the right in FIG. 3, and the quantity of operating fluid discharged into the reservoir R through the by-pass port 1*a* is decreased. Accordingly, because of the introduction of the load pressure, the quantity of operating fluid led into the discharge pressure chamber 25 from the input pressure chamber 24 is increased; that is, the quantity of operating fluid discharged into the steering device G is increased according to the load pressure. In FIG. 5, the relationships between pump rotational speeds and operating fluid quantities are indicated by a curve C-D.

In the above-described embodiment, the outer diameter of the elongated portion 16*a* of the spool valve 16 is changed in the axial direction; however, the invention is not limited thereto or thereby. That is, the inner diameter of the flow rate hole 19*a* of the sleeve member 19 may be changed in the axial direction. In addition, it goes without saying that the flow rate control device of the invention may be applied to hydraulic pumps other than vane pumps.

Figure 6:
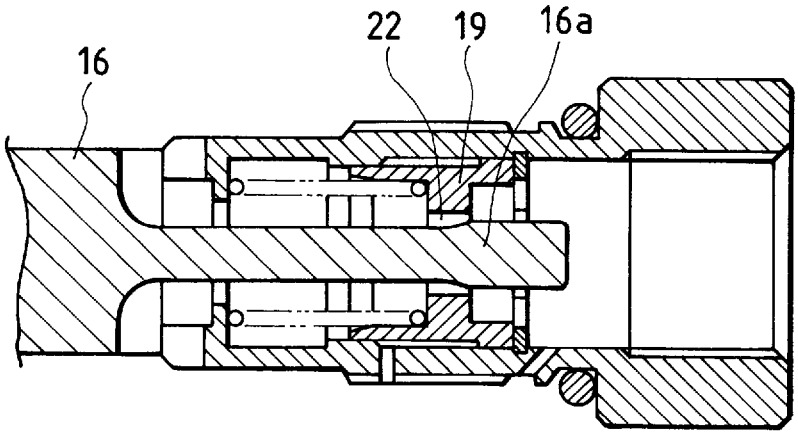
FIG. 6 is an enlarged sectional view showing a flow rate control device according to a second embodiment of the invention.

FIG. 6 is an enlarged cross-sectional view showing essential components of a flow rate control device in accordance with a second embodiment of the invention. In FIG. 6, parts corresponding functionally to those already described with reference to the first embodiment are therefore designated by the same reference numerals or characters.

As shown in FIG. 6, the choke tubular passageway 22 may be formed around a solid elongated portion 16*a* of the spool valve 16; in other words, the choke tubular passageway 22 may be defined only by the outer cylindrical surface of the elongated portion 16*a* and the inner cylindrical surface of the sleeve member 19.

Figure 7:
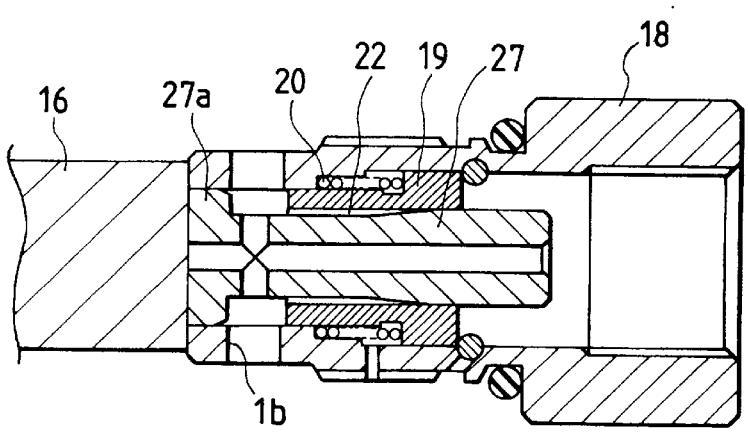
FIG. 7 is an enlarged sectional view showing a flow rate control device according to a third embodiment of the invention.

FIG. 7 is an enlarged cross-sectional view showing essential components of a flow rate control device in accordance with a third embodiment of the invention.

The third embodiment is different from the above-described first embodiment in the following point: A central shaft member 27 provided in addition to the spool valve 16 has a flange 27*a*. The outer periphery of the flange 27*a* is press-fitted in a plug 18, so that the central shaft member 27 be a fixed member. Moreover, the sleeve member 19 is so arranged as to be movable with respect to the central shaft member 27.

Figure 8:
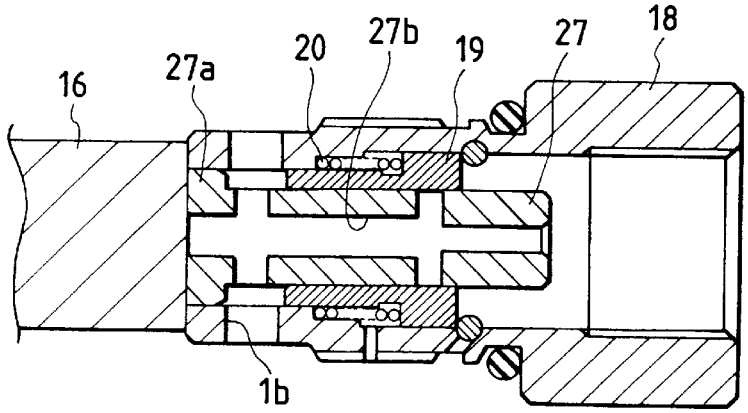
FIG. 8 is an enlarged sectional view showing a first modification of the flow rate control device shown in FIG. 7.

FIG. 8 is an enlarged cross-sectional view showing essential components of a first modification of the flow rate control device shown in FIG. 7. In the modification, as the sleeve member 19 moves axially, the opening of the flow passageway 27*b* formed in the aforementioned central shaft member 27 is changed in area.

Figure 9:
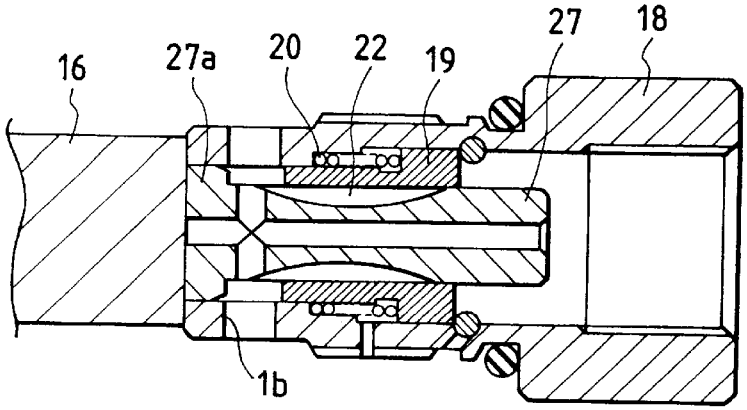
FIG. 9 is an enlarged sectional view showing a second modification of the flow rate control device shown in FIG. 7.

FIG. 9 is also an enlarged sectional view showing essential components of a second modification of the flow rate control device shown in FIG. 7. In the second modification, an arcuate slit is formed in the outer cylindrical surface of the central shaft member 27, thereby to form a choke tubular passageway 22.

As is apparent from the above description, the flow rate control device of the invention is the load-pressure sensitive flow rate control device which is small in size and light in weight. Hence, it can be manufactured at low cost, and allows to effectively utilize the engine room in the vehicle.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A flow rate control device for a pump, comprising:

a housing;

a pump pressure chamber provided in said housing, into which a pump discharge pressure is led;

a choke tubular passageway communicating with said pump pressure chamber;

an output chamber communicating through said choke tubular passageway with said pump pressure chamber, a pressure obtained by reducing the pump discharge pressure being led to said output chamber;

a pressure reducing chamber which is provided in said housing and communicates with said output chamber;

a by-pass port which is provided in said housing and communicates with a pump suction side;

a spool valve which is slidably provided in said housing, which has both ends exposed in said pump pressure chamber and said pressure reducing chamber, respectively, said spool valve causing a pressure medium from said pump pressure chamber to flow into said by-pass port as much as said spool valve slides in an axial direction thereof;

a central shaft member arranged in said housing, on which said choke tubular passageway is formed; and a sleeve member provided around said central shaft member;

wherein said sleeve member is moved from said pump pressure chamber towards said pressure reducing chamber with respect to said central shaft member in such a manner as to change an opening area of said choke tubular passageway.

2. A flow rate control device for a pump as claimed in claim 1, wherein said central shaft member is changed in outer diameter in an axial direction thereof to define said choke tubular passageway.

3. A flow rate control device for a pump as claimed in claim 1, wherein said sleeve member is changed in inner diameter in an axial direction thereof to define said choke tubular passageway.

4. A flow rate control device for a pump as claimed in claim 1, wherein said central shaft member has a pipe passageway formed therein, through which said output chamber communicates with said pump pressure chamber.

5. A flow rate control device for a pump as claimed in claim 1, wherein said central shaft member is solid.

6. A flow rate control device for a pump as claimed in claim 1, wherein said spool valve is integrated with said central shaft member.

7. A flow rate control device for a pump as claimed in claim 1, wherein said central shaft member is fixed to said housing.

8. A flow rate control device for a pump as claimed in claim 7, wherein said central shaft member has a pipe passageway formed therein.

9. A flow rate control device for a pump as claimed in claim 8, wherein, as the sleeve member moves axially, an opening of the pipe passageway formed in said central shaft member is changed in area.

10. A flow rate control device for a pump as claimed in claim 8, wherein an arcuate slit is formed in the outer cylindrical surface of said central shaft member to form said choke tubular passageway.

* * * * *